US011857133B2

(12) United States Patent
Hartz

(10) Patent No.: US 11,857,133 B2
(45) Date of Patent: Jan. 2, 2024

(54) USE OF RECYCLED WASH AND RINSE WATER FOR THE PRE-RINSE OPERATION OF DISHES

(71) Applicant: Ecolab USA Inc., St. Paul, MN (US)

(72) Inventor: Adrian E. Hartz, Woodbury, MN (US)

(73) Assignee: ECOLAB USA INC., St. Paul, MN (US)

( * ) Notice: Subject to any disclaimer, the term of this patent is extended or adjusted under 35 U.S.C. 154(b) by 0 days.

(21) Appl. No.: 17/869,615

(22) Filed: Jul. 20, 2022

(65) Prior Publication Data

US 2022/0354337 A1 Nov. 10, 2022

Related U.S. Application Data

(63) Continuation of application No. 15/450,820, filed on Mar. 6, 2017, now Pat. No. 11,432,701, which is a continuation of application No. 13/224,991, filed on Sep. 2, 2011, now Pat. No. 9,603,501.

(51) Int. Cl.
*A47L 15/42* (2006.01)
*A47L 15/00* (2006.01)

(52) U.S. Cl.
CPC ..... *A47L 15/4291* (2013.01); *A47L 15/0005* (2013.01); *A47L 15/0076* (2013.01); *A47L 15/0081* (2013.01); *A47L 15/4219* (2013.01)

(58) Field of Classification Search
CPC ..... A47L 15/0005; A47L 15/0076; A47L 15/0081; A47L 15/4219; A47L 15/4291
USPC ..... 134/60
See application file for complete search history.

(56) References Cited

U.S. PATENT DOCUMENTS

| | | | |
|---|---|---|---|
| 1,572,686 | A | 2/1926 | Schertz |
| 1,645,815 | A | 10/1927 | Murdoch |
| 2,709,444 | A | 5/1955 | Ortega |
| 2,722,941 | A | 11/1955 | Bartlett |
| 2,750,950 | A | 6/1956 | Inman et al. |
| 3,230,961 | A | 1/1966 | Benkert et al. |
| 3,384,099 | A | 5/1968 | Baumann |
| 3,698,406 | A | 10/1972 | Sato et al. |
| 3,709,236 | A | 1/1973 | Field et al. |

(Continued)

FOREIGN PATENT DOCUMENTS

KR 10-0867531 11/2008

OTHER PUBLICATIONS

"Salvajor Scrap Collector—How It Works", The Salvajor Company, Kansas City, Missouri, USA, 1 page, date of printing unknown (art known of prior to filing of present application).

*Primary Examiner* — Tinsae B Ayalew
(74) *Attorney, Agent, or Firm* — Merchant & Gould P.C.

(57) ABSTRACT

A dishwashing machine is used for pre-rinse operation of soiled dishes. A cavity is configured and arranged to contain the soiled dishes. A nozzle is proximate the cavity and is in fluid communication with the cavity. An accumulator pan accumulates wash and rinse water including cleaning chemicals used in a previous cycle of the dishwashing machine. A fluid passageway interconnects the nozzle and the accumulator pan. A pump directs the accumulated wash and rinse water from the accumulator pan to the nozzle via the fluid passageway for pre-rinse operation of the soiled dishes in the cavity, and the nozzle directs the accumulated wash and rinse water into the cavity with the soiled dishes to assist in removing soil from the soiled dishes prior to a wash cycle of the dishwashing machine. The wash cycle utilizes fresh wash water.

11 Claims, 10 Drawing Sheets

(56) References Cited

U.S. PATENT DOCUMENTS

| | | | |
|---|---|---|---|
| 3,807,636 | A | 4/1974 | Fackler |
| 3,949,772 | A | 4/1976 | Hartmann |
| 3,965,914 | A | 6/1976 | Walker, Jr. |
| 4,088,145 | A | 5/1978 | Noren |
| 4,810,306 | A | 3/1989 | Noren |
| 5,031,650 | A | 7/1991 | Nagata et al. |
| 5,056,542 | A | 10/1991 | Reinhard |
| 5,193,562 | A | 3/1993 | Rigby et al. |
| 5,357,992 | A | 10/1994 | Yang |
| 5,732,724 | A | 3/1998 | Becknell |
| 5,934,298 | A | 8/1999 | Singh |
| 6,092,114 | A | 7/2000 | Shaffer et al. |
| 6,092,540 | A | 7/2000 | Chiao |
| 6,092,541 | A | 7/2000 | Crane et al. |
| 6,101,643 | A | 8/2000 | Moore |
| 6,289,908 | B1 | 9/2001 | Kelsey |
| 6,659,114 | B2 | 12/2003 | Bigott |
| 9,603,501 | B2 | 3/2017 | Hartz |
| 11,432,701 | B2 | 9/2022 | Hartz |
| 2003/0205246 | A1 | 11/2003 | Christman et al. |
| 2003/0205256 | A1 | 11/2003 | DeBoer et al. |
| 2004/0194810 | A1 | 10/2004 | Strothoff et al. |
| 2008/0184746 | A1 | 8/2008 | Agarwal |
| 2009/0159097 | A1 | 6/2009 | Berner et al. |
| 2011/0197934 | A1 | 8/2011 | Fueglein et al. |
| 2011/0232690 | A1 | 9/2011 | Ericsson et al. |
| 2011/0253173 | A1 | 10/2011 | Fransson |

USE OF RECYCLED WASH AND RINSE WATER FOR THE PRE-RINSE OPERATION OF DISHES

CROSS REFERENCE TO RELATED APPLICATIONS

This application is a continuation of U.S. Application Ser. No. 15/450,820, filed Mar. 6, 2017, entitled "Use of Recycled Wash and Rinse Water for the Pre-Rinse Operation of Dishes," which is a continuation of U.S. Application Ser. No. 13/224,991, filed Sep. 2, 2011, now U.S. Pat. No. 9,603,501, issued Mar. 28, 2017, entitled "Use of Recycled Wash and Rinse Water for the Pre-Rinse Operation of Dishes," which is incorporated by reference herein in its entirety.

FIELD OF THE INVENTION

The present invention relates to the use of recycled wash and rinse water for pre-rinse operation in a dishwashing machine.

BACKGROUND OF THE INVENTION

A typical dishwashing process includes manually removing large food particles from soiled dishes using a spatula, tapping the dishes against the side or the edge of a waste container, or other suitable methods. In commercial applications, the operator typically then sprays the soiled dishes with fresh, warm to hot water using a pre-rinse spray hose. In a typical manual pre-rinse operation, the operator uses a commercially available pre-rinse spray hose to spray fresh water onto the soiled dishes, which does not contain any chemicals and is typically at a temperature of between 100 and 120° F. The dishes are then loaded into a dish rack of a dishwashing machine. Optionally, when using a door type, single rack, dishwashing machine, the operator will load the soiled dishes into the dish rack of the dishwashing machine and then use the pre-rinse hose to pre-rinse the dishes. The dish rack is then loaded into the cavity of the dishwashing machine for the automatic wash and rinse operations of the dishwashing machine.

Commercial door type dishwashing machines generally fall into the following four categories: high temperature sanitizing dishwashing machines, chemical sanitizing dishwashing machines, fresh water rinse dishwashing machines, and "dump and fill" dishwashing machines. Many combinations of these categories exist. Wash and rinse times, temperatures, and mechanical action are regulated by NSF standards. In all cases, a portion of the wash and/or rinse water is drained from the machine, either by directly opening a drain mechanism or by using an overflow conduit. The drained water is relatively clean as the water will typically pass through some filtering devices such as screens before reaching the sewer drain. Depending upon the type of dishwashing machine, the temperature of the drained water will typically be between 110 and 150° F., and the water will contain chemicals such as detergent, rinse aid, and sanitizing chemicals.

It is desired to reduce the amount of water and energy used to wash dishes, including the pre-rinse of dishes. Rather than using fresh, heated water in the pre-rinse operation of the dishes, the present invention uses the waste water of the dishwashing machine in the pre-rinse operation of the dishes to reduce the amount of water and energy used to wash dishes.

SUMMARY OF THE INVENTION

In one aspect of the present invention, a dishwashing machine is used for pre-rinse operation of soiled dishes. A cavity is configured and arranged to contain the soiled dishes. A nozzle is proximate the cavity and is in fluid communication with the cavity. An accumulator pan accumulates wash and rinse water including cleaning chemicals used in a previous cycle of the dishwashing machine. A fluid passageway interconnects the nozzle and the accumulator pan. A pump directs the accumulated wash and rinse water from the accumulator pan to the nozzle via the fluid passageway for pre-rinse operation of the soiled dishes in the cavity, and the nozzle directs the accumulated wash and rinse water into the cavity with the soiled dishes to assist in removing soil from the soiled dishes prior to a wash cycle of the dishwashing machine. The wash cycle utilizes fresh wash water.

In another aspect of the present invention, a dishwashing machine is used for pre-rinse operation of soiled dishes for use with a dispenser for dispensing a use solution. A first cavity is configured and arranged to contain first dishes. A first nozzle is contained within the first cavity. A first pump is configured and arranged to direct use solution from the first cavity into the first nozzle in the first cavity, and the first nozzle is configured and arranged to direct the use solution onto the first dishes in the first cavity. A second cavity is in fluid communication with the first cavity and is configured and arranged to contain second dishes. A second nozzle is in fluid communication with the second cavity. A second pump is configured and arranged to direct use solution received from the first cavity into the second nozzle, and the second nozzle is configured and arranged to direct the use solution onto the second dishes in the second cavity.

In another aspect of the present invention, a dishwashing machine is used for pre-rinse operation of soiled dishes. A cavity is configured and arranged to contain the soiled dishes. A first nozzle and a second nozzle are proximate the cavity and are in fluid communication with the cavity. A sump is configured and arranged to contain wash water. An accumulator pan accumulates wash and rinse water including chemicals used in at least one previous wash cycle of the dishwashing machine. The sump is in fluid communication with the accumulator pan. A first fluid passageway interconnects the first nozzle and the accumulator pan. A first pump directs the accumulated wash and rinse water from the accumulator pan to the first nozzle via the first fluid passageway for pre-rinse operation of the soiled dishes in the cavity, and the first nozzle directs the accumulated wash and rinse water into the cavity with the soiled dishes to assist in removing soil from the soiled dishes prior to a wash cycle of the dishwashing machine. A second fluid passageway interconnects the second nozzle and the sump. A second pump directs the wash water from the sump to the second nozzle via the second fluid passageway. The wash cycle utilizes fresh wash water, and the wash water used in the wash cycle is emptied from the sump into the accumulator pan.

In another aspect of the present invention, a method of recycling wash and rinse water used in wash and rinse cycles of a dishwashing machine for use in pre-rinse operation of soiled dishes comprises running the wash and rinse cycles of the dishwashing machine, collecting the wash and rinse water from the wash and rinse cycles, placing the soiled dishes in a cavity, and directing the collected wash and rinse water into the cavity proximate the soiled dishes thereby providing pre-rinse operation of the soiled dishes with the collected wash and rinse water from previous wash and rinse cycles of the dishwashing machine. The cavity could be part of or separate from the dishwashing machine and could be selected from the group consisting of a portion of the dishwashing machine, a sink, or a portion of another dishwashing machine. The collected wash and rinse water could be drained after use in the pre-rinse operation of the soiled dishes.

DETAILED DESCRIPTION OF A PREFERRED EMBODIMENT

Figure 3:
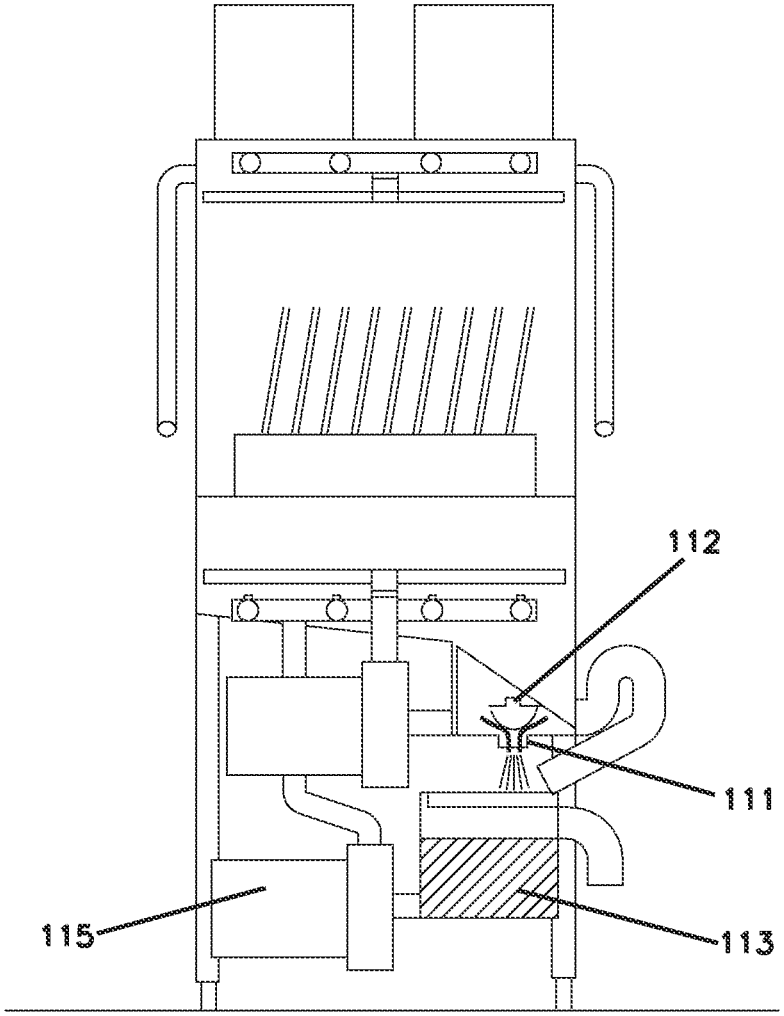
FIG. 3 is a front partial cross section view of the dishwashing machine shown in FIG. 1 during the drain operation of the dishwashing machine.
Figure 4:
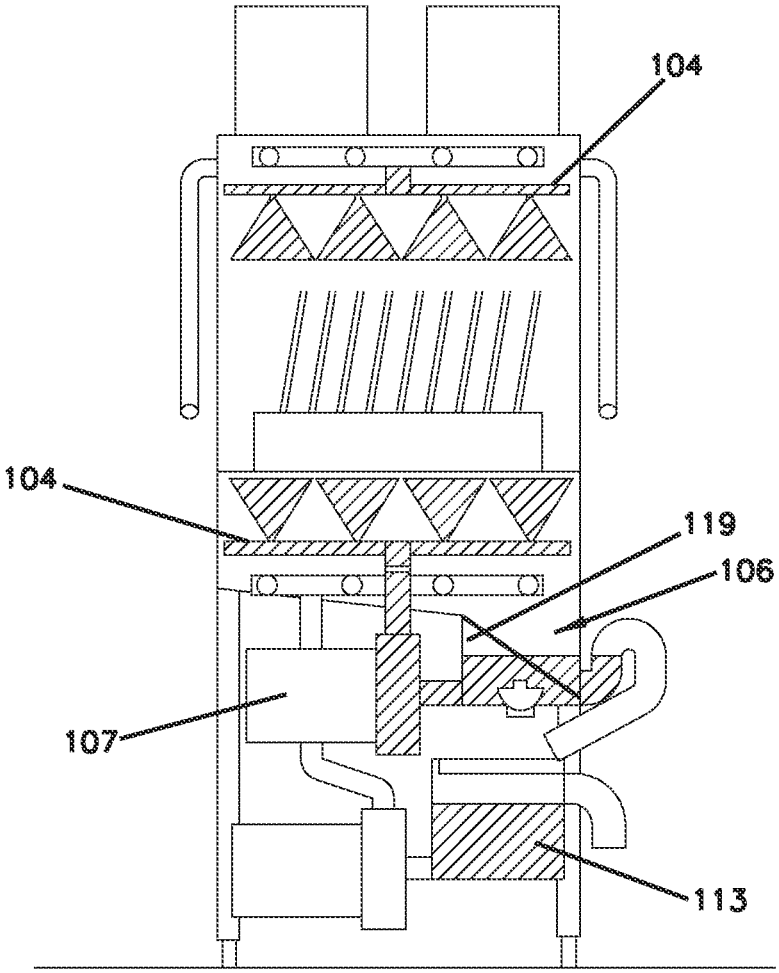
FIG. 4 is a front partial cross section view of the dishwashing machine shown in FIG. 1 during the wash operation of the dishwashing machine.
Figure 5:
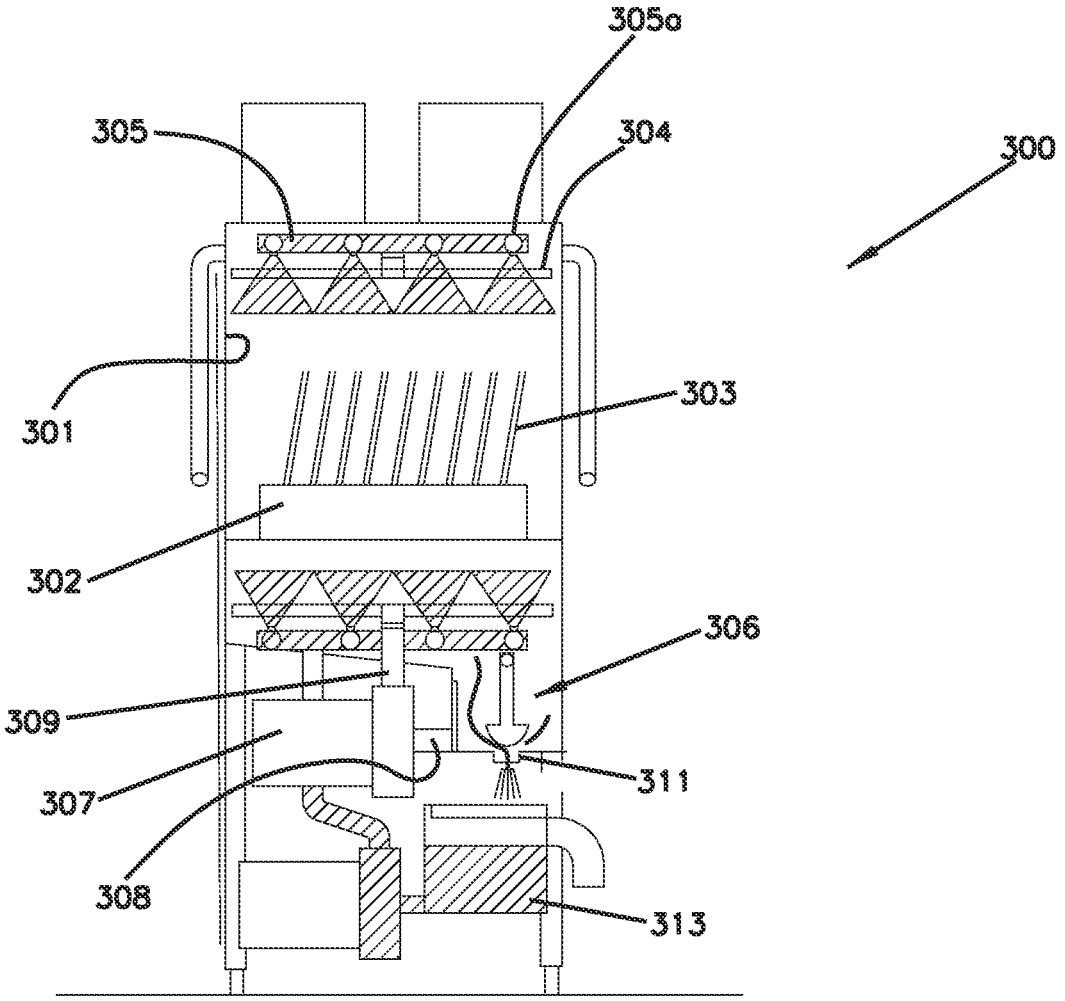
FIG. 5 is a front partial cross section view of another embodiment dishwashing machine including a standard drain constructed according to the principles of the present invention during the pre-rinse operation of the dishwashing machine.
Figure 6:
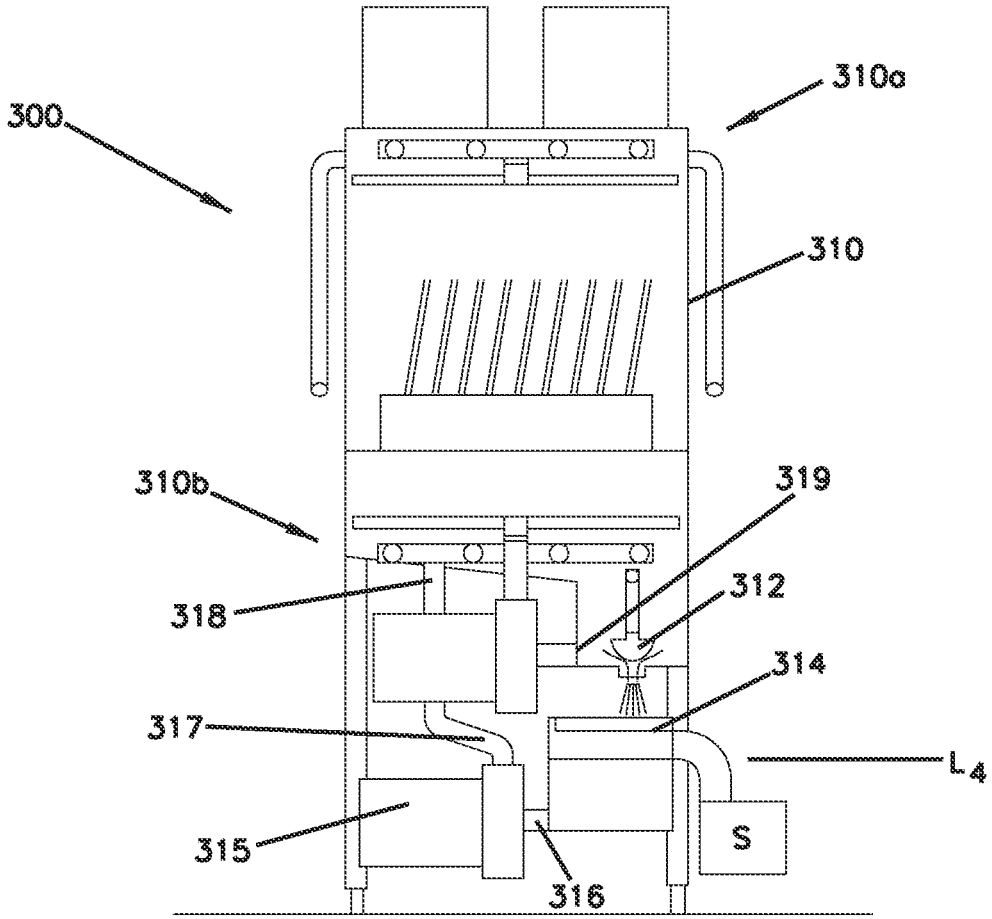
FIG. 6 is a front partial cross section view of the dishwashing machine shown in FIG. 5 during the drain operation of the dishwashing machine.
Figure 7:
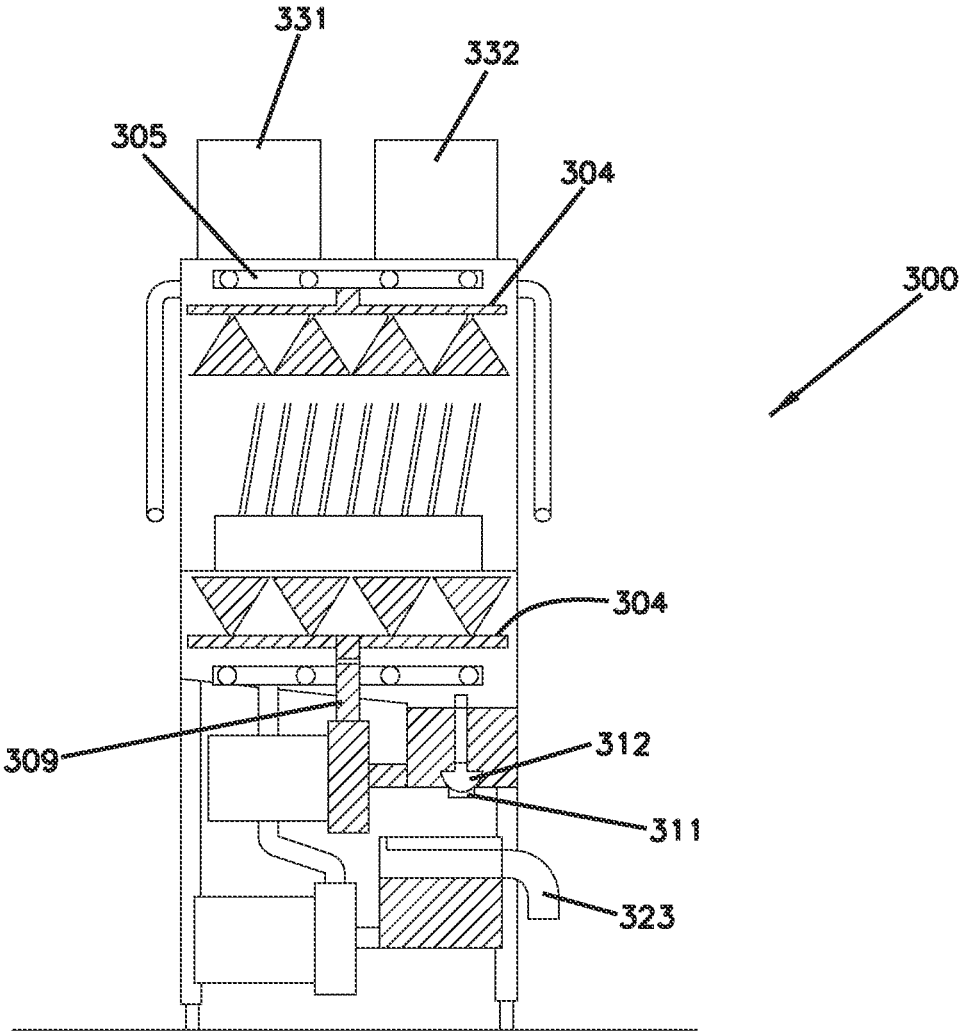
FIG. 7 is a front partial cross section view of the dishwashing machine shown in FIG. 5 during the wash operation of the dishwashing machine.
Figure 8:
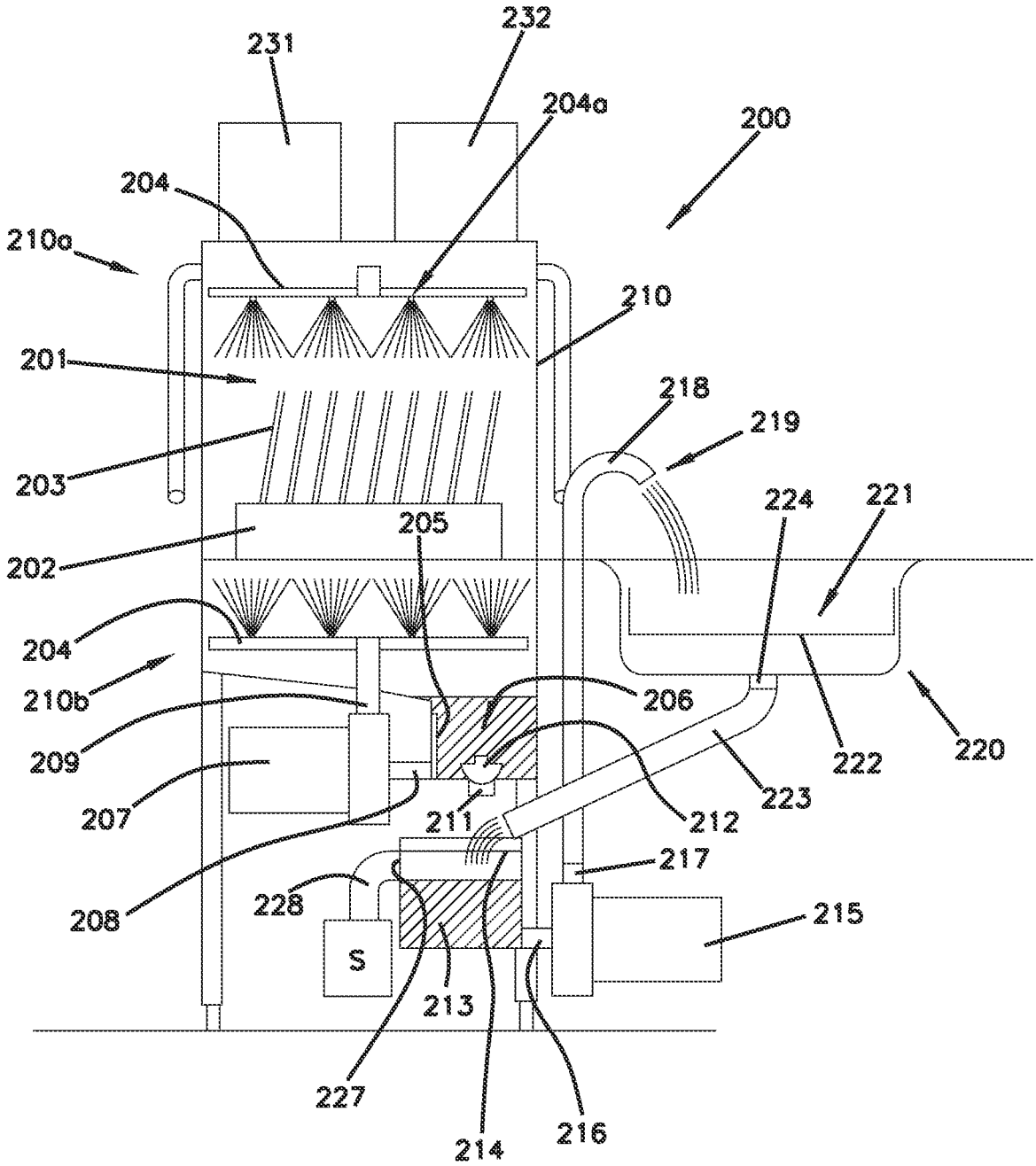
FIG. 8 is a front partial cross section view of another embodiment dishwashing machine constructed according to the principles of the present invention during the pre-rinse operation of the dishwashing machine.
Figure 9:
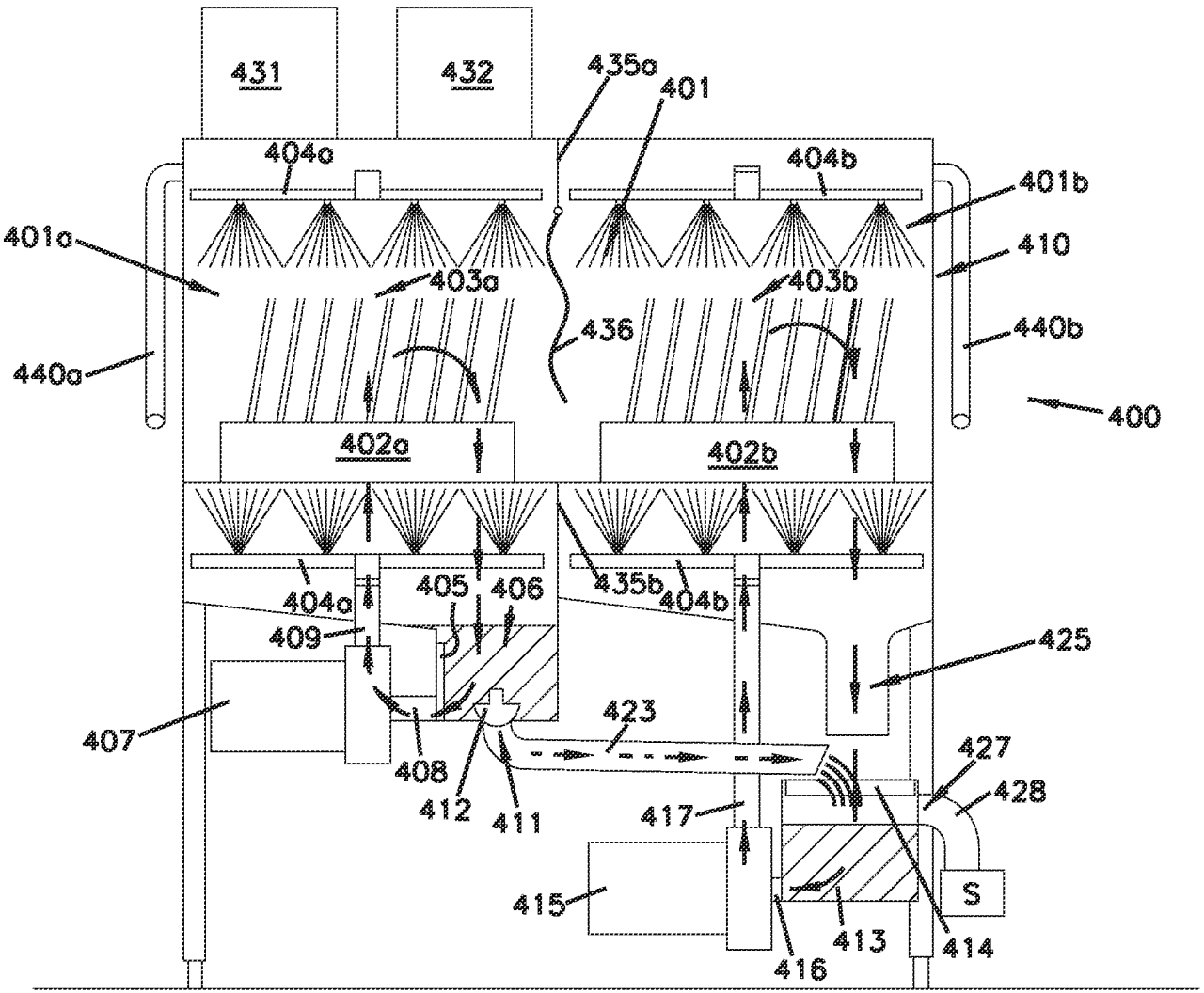
FIG. 9 is a front partial cross section view of another embodiment dishwashing machine constructed according to the principles of the present invention during the pre-rinse operation of the dishwashing machine.
Figure 10:
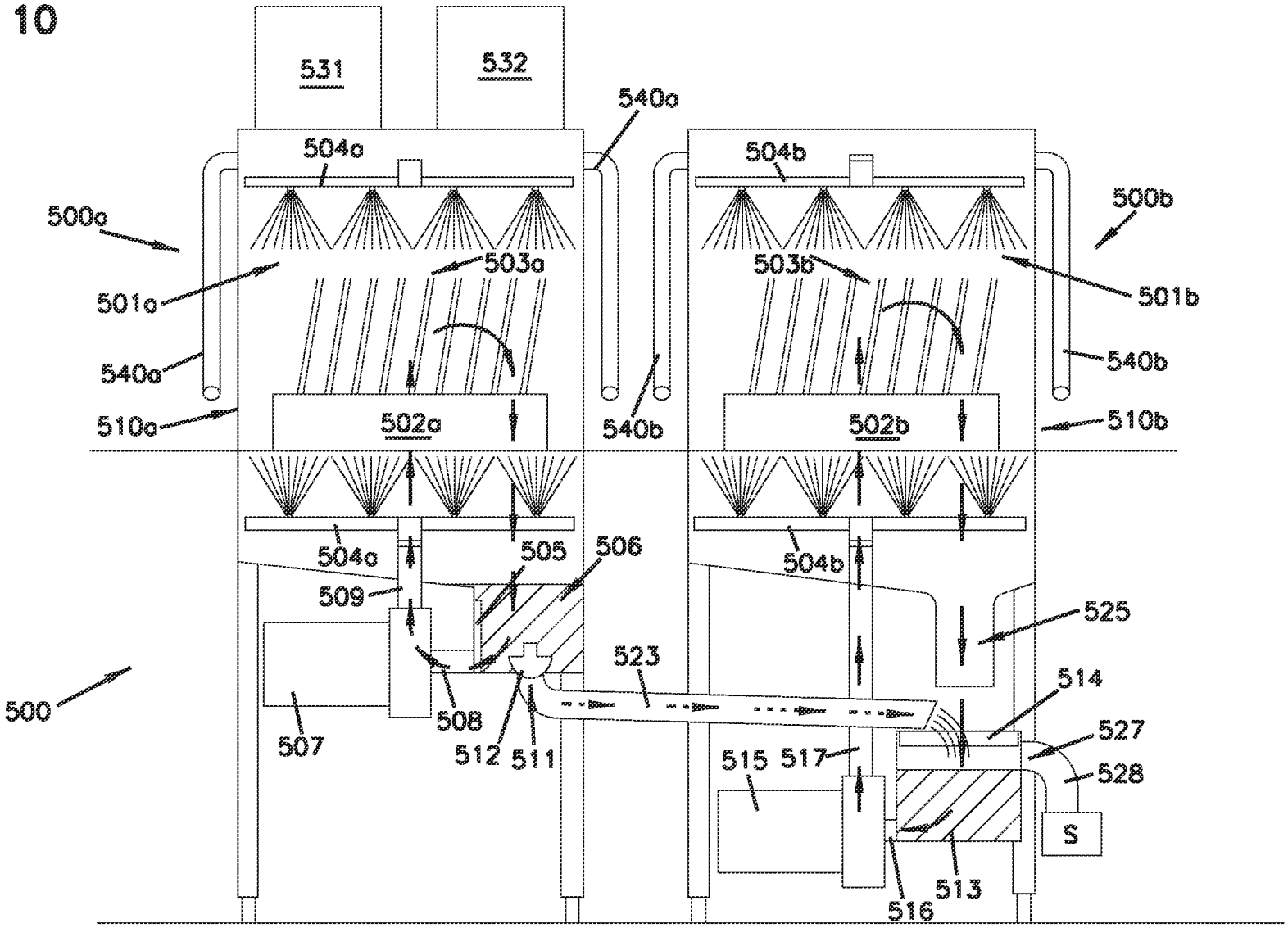
FIG. 10 is a front partial cross section view of another embodiment dishwashing machine constructed according to the principles of the present invention during the pre-rinse operation of the dishwashing machine.

A preferred embodiment dishwashing machine constructed according to the principles of the present invention is designated by the numeral 100 in FIGS. 1-4, by the numeral 300 in FIGS. 5-7, by the numeral 200 in FIG. 8, by the numeral 400 in FIG. 9, and by numeral 500 in FIG. 10.

Generally, the present invention reduces the total water consumption, including the water used in the manual pre-rinse operation and the water used in the dishwashing machine, and associated energy and sewage costs in the dishwashing process. Further, the total amount of cleaning chemicals is reduced during the complete cycle, and the amount of manual labor required is reduced. The present invention reuses the waste water drained from the dishwashing machine in the previous wash and rinse cycles for the pre-rinse operation. At a minimum, hot water used during the pre-rinse operation will be proximate the temperature used during the typical manual pre-rinse operation. Also, the waste water will contain cleaning chemicals such as, but not limited to, detergent, rinse aid, and sanitizer used by the dishwashing machine. This water can be used for a typical manual type pre-rinse operation, as shown in FIG. 8, where the soiled dishes are rinsed before being placed within the cavity of the dishwashing machine. Alternatively, as shown in FIGS. 1-7, 9, and 10, a pre-rinse operation can be included within the cavity of the dishwashing machine so that the manual pre-rinse operation can be eliminated and replaced by an automatic pre-rinse cycle within the operation of the dishwashing machine.

Some of the embodiments of the present invention are disclosed with regard to a dump and fill type dishwashing machine, but it is recognized that a re-circulating type dishwashing machine could be used as well. Generally, a dump and fill type dishwashing machine uses the rinse water from a previous cycle for the wash water, which includes detergent added to the rinse water, in the subsequent cycle. Generally, a re-circulating type dishwashing machine uses the wash water and the rinse water for the wash water in subsequent cycles until the re-circulated wash water is emptied from the dishwashing machine.

FIGS. 1-4 show a preferred embodiment dishwashing machine 100, which is a commercial dump and fill door-type dishwashing machine, including a siphon drain 122. The dishwashing machine 100 includes a housing 110 defining a cavity 101 within which a rack 102 is configured and arranged to hold dishes 103 in an upright, generally vertical position within the cavity 101. Wash arms 104 and pre-rinse arms 105 are preferably rotatably operatively connected proximate the top 110*a* and the bottom 110*b* of the housing 110 within the cavity 101. The wash arms 104 include nozzles (not shown) through which wash water is dispensed onto the dishes 103 within the cavity 101 as the wash arms 104 rotate. The pre-rinse arms 105 include nozzles 105*a* through which waste water is dispensed onto the dishes 103 within the cavity 101 as the pre-rinse arms 105 rotate. It is recognized that many suitable types of nozzles, including but not limited to spray arms, could be used.

The bottom 110*b* of the housing 110 slants, shown slanting from the left side to the right side of the housing 110 in a downward direction, to allow waste water to flow by gravity into a sump 106 in fluid communication with the cavity 101. It is recognized that the housing 110 could slant in any suitable manner. A pump 107 having a pump inlet 108 and a pump outlet 109 is in fluid communication with the sump 106. The pump inlet 108 interconnects the sump 106 and the pump 107, and the pump outlet 109 interconnects the pump 107 and the wash arms 104. A strainer 119, which is preferably a screen member, within the sump 106 proximate the pump inlet 108 is configured and arranged to allow water through but to prevent larger food particles from going through the strainer 119 into the pump 107. The sump 106 includes a drain 111 proximate the bottom of the sump 106, and a stopper 112 is configured and arranged to plug the drain 111. The stopper 112 is preferably an electro-mechanical device well known in the art. When the stopper 112 is unplugged from the drain 111, the drain 111 is open and in fluid communication with an accumulator pan 113. A strainer 114, which is preferably a removable screen member, proximate the opening into the accumulator pan 113 is configured and arranged to allow waste water through but to prevent larger food particles from going through the strainer 114 into the accumulator pan 113. A pump 115 having a pump inlet 116 and a pump outlet 117 is in fluid communication with the accumulator pan 113. The pump inlet 116 interconnects the accumulator pan 113 and the pump 115, and the pump outlet 117 interconnects the pump 115 and a fluid passageway 118, which interconnects the pump outlet 117 and the pre-rinse arms 105.

A siphon drain 122 is in fluid communication with the sump 106 proximate the bottom of the sump 106. The siphon drain 122 extends upward from proximate the bottom of the sump 106 to proximate the top of the sump 106 and then curves downward to empty into the accumulator pan 113 preferably located below the sump 106. The height of the top of the point of curvature 122*a* of the siphon drain 122 is preferably proximate a maximum desired water level $L_2$ within the sump 106. During each cycle of the dishwashing machine 100, the water in the sump 106 reaches approximately or less than a level $L_1$, which is below the height of the top of the point of curvature 122*a*, and as water is added to the sump 106 and the level reaches the maximum desired water level $L_2$ within the sump 106, the water is siphoned out of the sump 106 via the siphon drain 122 as is well known in the art. Another strainer 121, which is preferably a screen member, within the sump 106 proximate the bottom 110*b* of the housing 110 and angled downward proximate the bottom of the opening into the siphon drain 122 is configured and arranged to allow water through but to prevent larger food particles from going through the strainer 121 into the bottom of the sump 106. The opening in the siphon drain 122 is preferably larger than the opening in the drain 111. When water is drained through the siphon drain 122, the larger food particles are more quickly directed out of the sump 106 through the siphon drain 122 rather than through the drain 111. For example, at the end of the pre-rinse operation, the larger food particles are caught by the strainer 121 and directed out of the housing 110 through the siphon drain 122 along with waste water.

An overflow drain 123 is in fluid communication with the accumulator pan 113. The overflow drain 123 is positioned at a level $L_3$ within the accumulator pan 113 to prevent the accumulator pan 113 from overflowing, and the excess water in the accumulator pan 113 flows through the overflow drain 123 to the sewer S. As the dishwashing machine 100 runs through several cycles, waste water is added to the accumulator pan 113. The additional waste water "refreshes" the water in the accumulator pan 113 with relatively warmer water and water including additional cleaning chemicals such as but not limited to detergent, rinse aid, and sanitizer. The additional waste water increases the water level within the accumulator pan 113, and the excess water is directed out of the accumulator pan 113 via the overflow drain 123. The dishwashing machine 100 may also include product dispensers 131 and 132 for dispensing detergent, rinse aid, and/or sanitizer during the respective wash or rinse cycle of the dishwashing machine 100.

In operation, soiled dishes 103 in rack 102 are placed within the cavity 101 of the housing 110 of the dishwashing machine 100. The pre-rinse operation is initiated. The stopper 112 is lifted to open the drain 111, draining water from the previous cycle into the accumulator pan 113 through the accumulator strainer 114. At the beginning of the day, waste water is preferably added to the accumulator pan 113 by running the dishwashing machine 100 through one or more wash cycles. During the day, waste water is added to the accumulator pan 113 as the dishwashing machine 100 runs through the several cycles. At the end of the day, or when the waste water becomes too soiled, the waste water is preferably allowed to drain out of the accumulator pan 113 by opening a manual ball valve (not shown) or other suitable drain device well known in the art.

During the pre-rinse operation, the pre-rinse pump 115 is activated to circulate water from the accumulator pan 113 through the pre-rinse arms 105 and nozzles 105*a* and over the dishes 103. Although the pre-rinse arms 105 are preferably rotatable, the pre-rinse arms 105 may be either stationary or rotatable. The pre-rinse nozzles 105*a* of the pre-rinse arms 105 will preferably include apertures of a larger size than those used in the wash and the rinse cycles to reduce clogging due to the larger food particles and debris likely to be included in the pre-rinse water. Also, lower pressure, higher volume water streams from the larger apertures are better for creating stronger flow streams, which assist in removing the larger food particles from the dishes 103. Because the soiled dishes 103 will contain relatively large sizes and amounts of food particles, which would have previously been manually removed from the dishes, the pre-rinse strainer 121, which is preferably a courser mesh, is used to keep these larger food particles out of the wash pump 107 and wash arms 104. After the water passes over the dishes 103, it passes through the pre-rinse strainer 121 and into the sump 106. Food particles collect on top of the pre-rinse strainer 121 proximate the siphon drain 122. The drain 111 remains open and the water returns to the accumulator pan 113.

Figure 1:
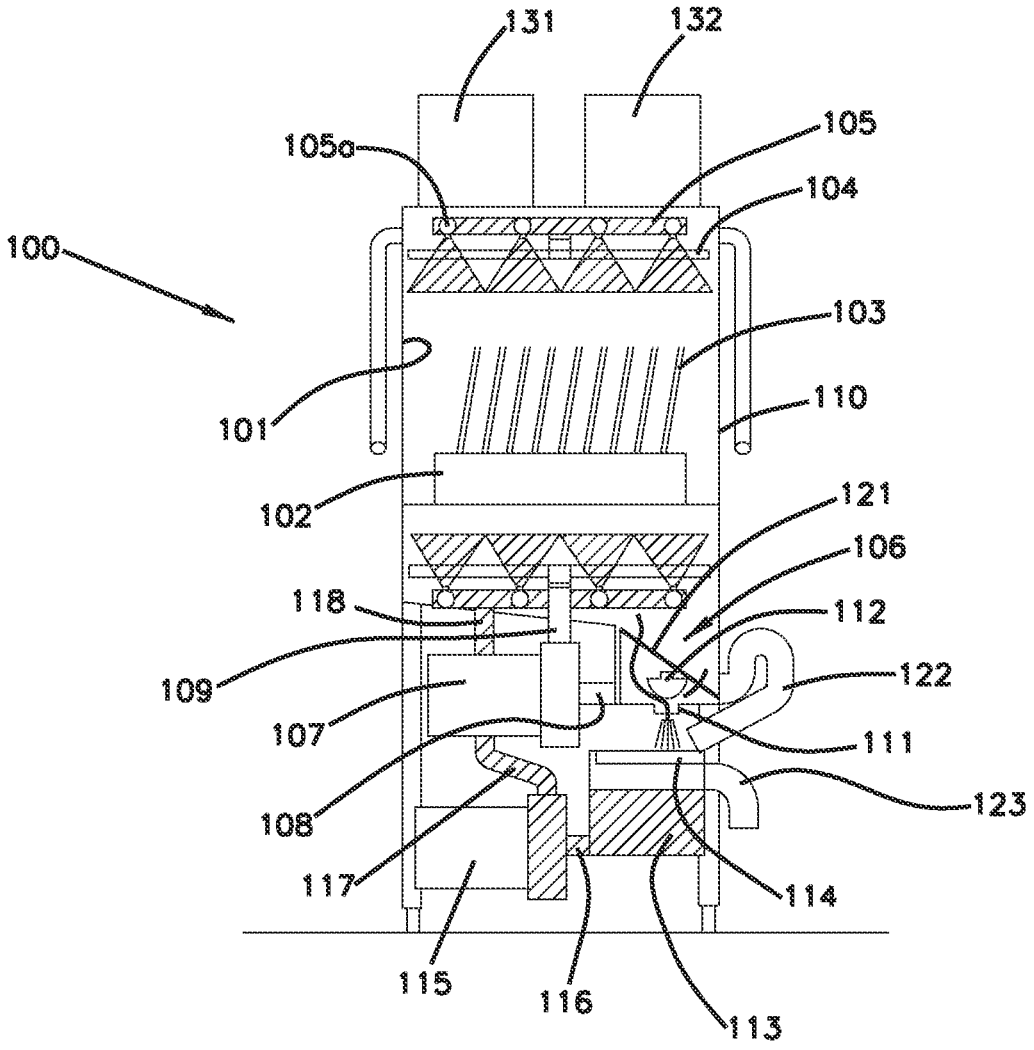
FIG. 1 is a front partial cross section view of a dishwashing machine including a siphon drain constructed according to the principles of the present invention during the pre-rinse operation of the dishwashing machine.
Figure 2:
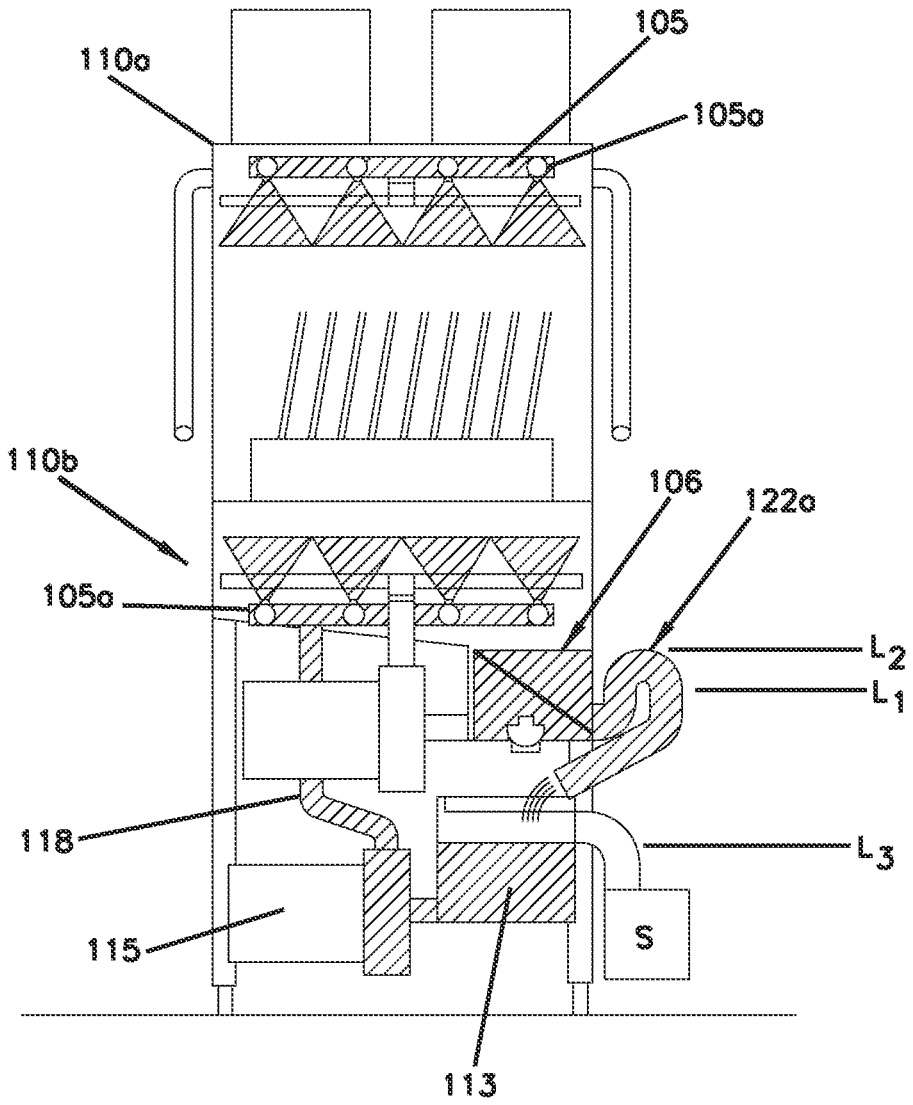
FIG. 2 is a front partial cross section view of the dishwashing machine shown in FIG. 1 during the pre-rinse drain operation of the dishwashing machine.

After completion of the pre-rinse operation, the drain 111 is closed. The pre-rinse pump 115 remains on, filling the sump 106 with water from the accumulator pan 113. If the waste water is lower than level $L_2$ within the sump 106, additional water is added by pumping water from the accumulator pan 113 to increase the level within the sump 106 to at least level $L_2$ within the sump 106, as shown in FIG. 2. This activates the siphon drain 122, which allows the larger food particles caught by the strainer 121 to be directed out of the sump 106, through the siphon drain 122, through the strainer 114, and into the accumulator pan 113 and the pump 115 is turned off.

The typical amount of water used in each cycle is approximately 1.0 to 2.0 gallons and the water level typically reaches level $L_1$ or less, which is below the top height 122*a* of the siphon drain 122. When the water level reaches the top height 122*a* of the siphon drain 122, preferably at least 2.5 gallons of water, the pre-rinse pump 115 is turned off and the water and food particles from the sump 106 are siphoned through the siphon drain 122, through the accumulator strainer 114, and into the accumulator pan 113. When the level of waste water reaches at least level $L_2$, which is the top height 122*a* of the siphon drain 122, a siphoning effect will cause the waste water from the sump 106 to siphon out of the sump 106 through the siphon drain 122 into the accumulator pan 113. When the waste water has been siphoned through the siphon drain 122, the waste water remaining proximate the point of curvature 122*a* of the siphon drain 122 will drain back into the sump 106, and this remaining waste water will be drained through the drain 111 when the stopper 112 is lifted. The opening and the hollow space of the siphon drain 122 is preferably at least 1.5 to 2.0 inches in diameter. The siphon action "pulls" the filtered food particles off of the top of the pre-rinse strainer 121. At the completion of the siphon drain sequence, any remaining waste water in the sump 106 is drained by unplugging the stopper 112 and allowing the waste water to flow out of the drain 111 into the accumulator pan 113, as shown in FIG. 3. The stopper 112 is preferably controlled by electro-mechanical means well known in the art. The strainer 114 catches larger food particles to prevent them from entering the accumulator pan 113, and the strainer 114 may be removed to dispose of the larger food particles. Any food particles small enough to pass through the strainer 121 are drained with the waste water from the drain 111 of the sump 106 through the strainer 114 into the accumulator pan 113. The food particles are either caught by the strainer 114 or flow into the accumulator pan 113. The drain 111 is closed, and the sump 106 is then substantially empty and ready for the wash cycle. The sump 106 is filled with fresh water and a detergent for the wash cycle as shown in FIG. 4. As additional machine cycles are run, the water level in the accumulator pan 113 increases until it reaches the overflow level $L_3$, at which point the water drains into the sewer S by gravity.

During the wash operation, as shown in FIG. 4, fresh water and detergent are supplied to the sump 106 and the pump 107 is activated to circulate the wash water through the wash arms 104 and the nozzles, onto the dishes 103, and back into the sump 106. The pump 107 supplies the wash water to the upper and the lower wash arms 104 which are fitted with spray nozzles (not shown). A strainer 119, which is preferably a fine mesh, exists to filter larger food particles from the water which may become lodged in the pump 107 or the wash arms 104. The wash water accumulates in the sump 106. The level of the water during the wash cycle is not high enough to cause a siphon drain to occur. After completion of the wash sequence, the drain 111 is opened and the water is drained into the accumulator pan 113. The wash water passes through a strainer 114 to filter larger food particles from the water entering the accumulator pan 113. The sump 106 is again filled with fresh water and optionally a rinse aid and a sanitizer. The wash pump 107 is activated and the rinse water is circulated through the upper and the lower wash arms 104 and nozzles, over the dishes 103, and into the sump 106. The cycle is complete, and the dishes 103 are removed from the dishwashing machine 100. The rinse cycle is similar to the wash cycle shown in FIG. 4. Because of the internal pre-rinse operation, the rinse water does not become the wash water in the next wash cycle. Rather, both the wash water and the rinse water are drained into the accumulator pan 113.

The sump 106 and the accumulator pan 113 collect water, which includes fresh water, wash water, rinse water, sanitizing water, and various other types of waste water recognized in the art. It is recognized that the use of one of these terms is not limited to that term but may also include any other suitable type of water recognized in the art.

Optionally, the pre-rinse operation of the dishwashing machine 100 could be bypassed for washing lightly soiled dishes such as glassware not requiring a pre-rinse. Also, the siphon drain 122 could be replaced with a more conventional drain mechanism, as shown in FIGS. 5-7. However, the more conventional drain mechanism should preferably be capable of removing relatively large amounts and sizes of food particles that will exist on dishes prior to the pre-rinse operation. The siphon drain 122 allows for the removal of relatively large amounts and sizes of food particles with less risk of clogging.

FIGS. 5-7 show another preferred embodiment dishwashing machine 300, which is a commercial dump and fill door-type dishwashing machine, including a standard drain 311. The dishwashing machine 300 includes a housing 310 defining a cavity 301 within which a rack 302 is configured and arranged to hold dishes 303 in an upright, generally vertical position within the cavity 301. Wash arms 304 and pre-rinse arms 305 are preferably rotatably operatively connected proximate the top 310*a* and the bottom 310*b* of the housing 310 within the cavity 301. The wash arms 304 include nozzles (not shown) through which wash water is dispensed onto the dishes 303 within the cavity 301 as the wash arms 304 rotate. The pre-rinse arms 305 include nozzles 305*a* through which waste water is dispensed onto the dishes 303 within the cavity 301 as the pre-rinse arms 305 rotate.

The bottom 310*b* of the housing 310 slants, shown slanting from the left side to the right side of the housing 310 in a downward direction, to allow waste water to flow by gravity into a sump 306 in fluid communication with the cavity 301. It is recognized that the housing 310 could slant in any suitable manner. A pump 307 having a pump inlet 308 and a pump outlet 309 is in fluid communication with the sump 306. The pump inlet 308 interconnects the sump 306 and the pump 307, and the pump outlet 309 interconnects the pump 307 and the wash arms 304. A strainer 319, which is preferably a screen member, within the sump 306 proximate the pump inlet 308 is configured and arranged to allow water through but to prevent larger food particles from going through the strainer 319 into the pump 307. The sump 306 includes a drain 311 proximate the bottom of the sump 306, and a stopper 312 is configured and arranged to plug the drain 311. The stopper 312 is preferably an electro-mechanical device well known in the art. When the stopper 312 is unplugged from the drain 311, the drain 311 is open and in fluid communication with an accumulator pan 313. A strainer 314, which is preferably a removable screen member, proximate the opening into the accumulator pan 313 is configured and arranged to allow waste water through but to prevent larger food particles from going through the strainer 314 into the accumulator pan 313. A pump 315 having a pump inlet 316 and a pump outlet 317 is in fluid communication with the accumulator pan 313. The pump inlet 316 interconnects the accumulator pan 313 and the pump 315, and the pump outlet 317 interconnects the pump 315 and a fluid passageway 318, which interconnects the pump outlet 317 and the pre-rinse arms 305. The dishwashing machine 300 does not include a siphon drain.

An overflow drain 323 is in fluid communication with the accumulator pan 313. The overflow drain 323 is positioned at a level $L_4$ within the accumulator pan 313 to prevent the accumulator pan 313 from overflowing, and the excess water in the accumulator pan 313 flows through the overflow drain 323 to the sewer S. As the dishwashing machine 300 runs through several cycles, waste water is added to the accumulator pan 313. The additional waste water "refreshes" the water in the accumulator pan 313 with relatively warmer water and water including additional chemicals. The additional waste water increases the water level within the accumulator pan 313, and the excess water is directed out of the accumulator pan 313 via the overflow drain 323. The dishwashing machine 300 may also include product dispensers 331 and 332 for dispensing detergent, rinse aid, and/or sanitizer during the respective wash or rinse cycle of the dishwashing machine 300.

In operation, soiled dishes 303 in rack 302 are placed within the cavity 301 of the housing 310 of the dishwashing machine 300. The pre-rinse operation is initiated. The stopper 312 is lifted to open the drain 311, draining water from the previous cycle into the accumulator pan 313 through the accumulator strainer 314. At the beginning of the day, waste water is preferably added to the accumulator pan 313 by running the dishwashing machine 300 through one or more wash cycles. During the day, waste water is added to the accumulator pan 313 as the dishwashing machine 300 runs through the several cycles. At the end of the day, or when the waste water becomes too soiled, the waste water is preferably allowed to drain out of the accumulator pan 313 by opening a manual ball valve (not shown) or other suitable drain device well known in the art.

During the pre-rinse operation, the pre-rinse pump 315 is activated to circulate water from the accumulator pan 313 through the pre-rinse arms 305 and nozzles 305*a* and over the dishes 303. Although the pre-rinse arms 305 are preferably rotatable, the pre-rinse arms 305 may be either stationary or rotatable. The pre-rinse nozzles 305*a* of the pre-rinse arms 305 will preferably include apertures of a larger size than those used in the wash and the rinse cycles to reduce clogging due to the larger food particles and debris likely to be included in the pre-rinse water. Also, lower pressure, higher volume water streams from the larger apertures are better for creating stronger flow streams, which assist in removing the larger food particles from the dishes 303. Because the soiled dishes 303 will contain relatively large sizes and amounts of food particles, which would have previously been manually removed from the dishes, the strainer 319, which is preferably a courser mesh, is used to keep these larger food particles out of the wash pump 307 and wash arms 304. After the water passes over the dishes 303, the water flows into the sump 306. The drain 311 remains open and the water returns to the accumulator pan 313 as shown in FIG. 6.

Food particles are drained from the sump 306 through the drain 311 into the accumulator pan 313. The strainer 314 catches larger food particles to prevent them from entering the accumulator pan 313, and the strainer 314 may be removed to dispose of the larger food particles. The drain 311 is closed, and the sump 306 is then substantially empty and ready for the wash cycle. The sump 306 is filled with fresh water and a detergent for the wash cycle as shown in FIG. 7. As additional machine cycles are run, the water level in the accumulator pan 313 increases until it reaches the overflow level $L_4$, at which point the water drains into the sewer S by gravity.

During the wash operation, as shown in FIG. 7, fresh water and detergent are supplied to the sump 306 and the pump 307 is activated to circulate the wash water through the wash arms 304 and the nozzles, onto the dishes 303, and back into the sump 306. The pump 307 supplies the wash water to the upper and the lower wash arms 304 which are fitted with spray nozzles (not shown). A strainer 319, which is preferably a fine mesh, exists to filter larger food particles from the water which may become lodged in the pump 307 or the wash arms 304. The wash water accumulates in the sump 306. After completion of the wash sequence, the drain 311 is opened and the water is drained into the accumulator pan 313. The wash water passes through the strainer 314 to filter larger food particles from the water entering the accumulator pan 313. The sump 306 is again filled with fresh water and optionally a rinse aid and a sanitizer. The wash pump 307 is activated and the rinse water is circulated through the upper and the lower wash arms 304 and nozzles, over the dishes 303, and into the sump 306. The cycle is complete, and the dishes 303 are removed from the dishwashing machine 300. The rinse cycle is similar to the wash cycle shown in FIG. 7. Because of the internal pre-rinse operation, the rinse water does not become the wash water in the next wash cycle. Rather, both the wash water and the rinse water are drained into the accumulator pan 313.

Optionally, the pre-rinse operation of the dishwashing machine 300 could be selectively bypassed for washing lightly soiled dishes such as glassware not requiring a pre-rinse. The sump 306 and the accumulator pan 313 collect water, which includes fresh water, wash water, rinse water, sanitizing water, and various other types of waste water recognized in the art. It is recognized that the use of one of these terms is not limited to that term but may also include any other suitable type of water recognized in the art.

FIG. 8 shows another preferred embodiment dishwashing machine 200, which is a commercial dump and fill door-type dishwashing machine, during an external pre-rinse operation of the dishwashing machine 200. The dishwashing machine 200 includes a housing 210 defining a cavity 201 within which a rack 202 is configured and arranged to hold dishes 203 in an upright, generally vertical position within the cavity 201. Wash arms 204 are preferably rotatably operatively connected proximate the top 210*a* and the bottom 210*b* of the housing 210 within the cavity 201. The wash arms 204 include nozzles 204*a* through which wash water is dispensed onto the dishes 203 within the cavity 201 as the wash arms 204 rotate.

The bottom 210*b* of the housing 210 slants, shown slanting from the left side to the right side of the housing 210 in a downward direction, to allow waste water to flow by gravity into a sump 206 in fluid communication with the cavity 201. It is recognized that the housing 210 could slant in any suitable manner. A pump 207 having a pump inlet 208 and a pump outlet 209 is in fluid communication with the sump 206. The pump inlet 208 interconnects the sump 206 and the pump 207, and the pump outlet 209 interconnects the pump 207 and the wash arms 204. Although the wash arms 204 are preferably rotatable, the wash arms 204 may be either stationary or rotatable. A strainer 205, which is preferably a screen member, within the sump 206 proximate the pump inlet 208 is configured and arranged to allow water through but to prevent larger food particles from going through the strainer 205 into the pump 207. The sump 206 includes a drain 211 proximate the bottom of the sump 206, and a stopper 212 is configured and arranged to plug the drain 211. The stopper 212 is preferably an electro-mechanical device well known in the art. When the stopper 212 is unplugged from the drain 211, the drain 211 is open and in fluid communication with an accumulator pan 213. A strainer 214, which is preferably a removable screen member, proximate the opening into the accumulator pan 213 is configured and arranged to allow waste water through but to prevent larger food particles from going through the strainer 214 into the accumulator pan 213. An overflow drain 228 is in fluid communication with an overflow outlet 227 of the accumulator pan 213. The overflow drain 228 is positioned at a level within the accumulator pan 213 to prevent the accumulator pan 213 from overflowing, and the excess water in the accumulator pan 213 flows through the overflow drain 228 to the sewer S. As the dishwashing machine 200 runs through several cycles, waste water is added to the accumulator pan 213. The additional waste water "refreshes" the water in the accumulator pan 213 with relatively warmer water and water including additional chemicals. The additional waste water increases the water level within the accumulator pan 213, and the excess water is directed out of the accumulator pan 213 via the overflow drain 228.

A pump 215 having a pump inlet 216 and a pump outlet 217 is in fluid communication with the accumulator pan 213. The pump inlet 216 interconnects the accumulator pan 213 and the pump 215, and the pump outlet 217 interconnects the pump 215 and a fluid passageway 218 operatively connected to a nozzle 219. The nozzle 219 could be operatively connected to a hand-directed nozzle well known in the art. The dishwashing machine 200 also includes an external sink 220 with a cavity 221 into which waste water is dispensed for use in an external pre-rinse operation. The fluid passageway 218 and the nozzle 219 are in fluid communication with the cavity 221. The sink 220 also includes a drain 224 in fluid communication with a fluid passageway 223 directing the waste water back into the accumulator pan 213. The external pre-rinse operation allows for larger dishes such as pots and pans or heavily soiled dishes to be pre-rinsed or soaked. Heavily soiled dishes could remain under the pre-rinse water stream for extended periods of time for improved pre-soaking performance versus simply soaking the dishes in stationary water. The waste water in the cavity 221 includes heat and cleaning chemicals from the wash water and the rinse water used during operation of the dishwashing machine 200. The dishwashing machine 200 may also include product dispensers 231 and 232 for dispensing detergent, rinse aid, and/or sanitizer during the respective wash or rinse cycle of the dishwashing machine 200. The dishwashing machine 200 does not include a siphon drain.

In operation, the stopper 212 in the sump 206 keeps the rinse water in the sump 206 for use in the next wash cycle, and detergent is added to the rinse water for use in the wash cycle. The pump 207 pumps the wash water from the sump 206 into the wash arms 204, and the wash water drains into the sump 206. After the wash cycle, the stopper 212 is lifted to unplug the drain 211 in the sump 206 to drain the wash water from the sump 206 into the accumulator pan 213. The wash water passes through the strainer 214 to filter out larger food particles from the wash water. The strainer 214 is preferably removable to aid in the disposal of the food particles. The wash water in the accumulator pan 213 is used during the pre-rinse cycle of the next cycle.

The pump 215 directs the wash water from the accumulator pan 213, through the fluid passageway 218, out of the pre-rinse nozzle 219, and into the cavity 221 of the sink 220. Although the pre-rinse arms 305 are preferably rotatable, the pre-rinse arms 305 may be either stationary or rotatable. The dishwashing machine 200 preferably has a control (not shown) to turn the pump 215 on or off to start or stop the flow of the pre-rinse water into the sink 220. The operator may hold a soiled dish under the pre-rinse stream in order to remove food particles from the dish. These food particles from the pre-rinse operation are collected in a removable pre-rinse strainer 222. Water from the pre-rinse operation is returned to the accumulator pan 213 via the fluid passageway 223 by gravity. The drain 224 is preferably open, but it is recognized that a stopper may be used to plug the drain 224 if it is desired to soak dishes in the sink 220. As additional machine cycles are run, the water level in the accumulator pan 213 increases until it reaches the bottom of the overflow drain 228, where the water drains into the sewer S by gravity. A manual ball valve (not shown) or other suitable drain device well known in the art is preferably used to drain the water from the accumulator pan 213 at the end of the day or when the water becomes too soiled.

Optionally, the accumulator pan 213 could be fitted with a water level sensing device so that the pump 215 does not turn on unless a sufficient amount of water is in the accumulator pan 213 to prevent damage to the pump 215. The accumulator pan 213 could also be fitted with a heating device that would maintain the temperature of the waste water within the accumulator pan 213 at a desired temperature, which is especially useful during periods of non-use. The heating device could be controlled such that it does not turn on when the pump 215 is running to minimize the total electrical load required for the dishwashing machine 200.

FIG. 9 shows another preferred embodiment dishwashing machine 400, which is shown as a dump and fill door-type dishwashing machine including a housing 410 defining a cavity 401 separated into a first portion 401*a* and a second portion 401*b* by a barrier including a first wall portion 435*a* to which a flexible curtain member 436 is operatively connected proximate a top of the dishwashing machine 400 and a second wall portion 435*b* proximate a bottom of the dishwashing machine 400. Door handles 440*a* and 440*b* are used to open a door (not shown) to access the cavity 401. A rack 402*a* configured and arranged to hold dishes 403*a* in an upright, generally vertical position is positioned within the first portion 401*a*, and a rack 402*b* configured and arranged to hold dishes 403*b* in an upright, generally vertical position is positioned within the second portion 401*b*. Wash arms 404*a* are preferably rotatably operatively connected proximate the top and the bottom of the first portion 401*a* within the cavity 401, and wash arms 404*b* are preferably rotatably operatively connected proximate the top and the bottom of the second portion 401*b* within the cavity 401. It is recognized that the wash arms 404*a* and 404*b* could also be stationary. The wash arms 404*a* include nozzles through which wash water is dispensed onto the dishes 403*a* within the first portion 401*a* of the cavity 401 as the wash arms 404*a* rotate. The wash arms 404*b* include nozzles through which pre-rinse water is dispensed onto the dishes 403*b* within the second portion 401*b* of the cavity 401 as the wash arms 404*b* rotate.

The bottom of the housing 410 in the first portion 401*a* slants, shown slanting from the left side to the right side of the housing 410 in a downward direction, to allow waste water to flow by gravity into a sump 406 in fluid communication with the cavity 401, and the bottom of the housing 410 in the second portion 401*b* slants, shown slanting from the left side to the right side of the housing 410 in a downward direction, to allow waste water to flow by gravity through a drain 425 into an accumulator pan 413 in fluid communication with the cavity 401. It is recognized that the housing 410 could slant in any suitable manner. A pump 407 having a pump inlet 408 and a pump outlet 409 is in fluid communication with the sump 406. The pump inlet 408 interconnects the sump 406 and the pump 407, and the pump outlet 409 interconnects the pump 407 and the wash arms 404*a*. A strainer 405, which is preferably a screen member, within the sump 406 proximate the pump inlet 408 is configured and arranged to allow water through but to prevent larger food particles from going through the strainer 405 into the pump 407. The sump 406 includes a drain 411 proximate the bottom of the sump 406, and a stopper 412 is configured and arranged to plug the drain 411. The stopper 412 is preferably an electro-mechanical device well known in the art. When the stopper 412 is unplugged from the drain 411, the drain 411 is open and in fluid communication with an accumulator pan 413 via a fluid passageway 423. A strainer 414, which is preferably a removable screen member, proximate the opening into the accumulator pan 413 is configured and arranged to allow waste water through but to prevent larger food particles from going through the strainer 414 into the accumulator pan 413. A pump 415 having a pump inlet 416 and a pump outlet 417 is in fluid communication with the accumulator pan 413. The pump inlet 416 interconnects the accumulator pan 413 and the pump 415, and the pump outlet 417 interconnects the pump 415 and the wash arms 404*b*. An overflow drain 428 is in fluid communication with an overflow outlet 427 of the accumulator pan 413. The overflow drain 428 is positioned at a level within the accumulator pan 413 to prevent the accumulator pan 413 from overflowing, and the excess water in the accumulator pan 413 flows through the overflow drain 428 to the sewer S. As the dishwashing machine 400 runs through several cycles, waste water from both portions 401*a* and 401*b* of the cavity 401 is added to the accumulator pan 413. The additional waste water "refreshes" the water in the accumulator pan 413 with relatively warmer water and water including additional chemicals. The additional waste water increases the water level within the accumulator pan 413, and the excess water is directed out of the accumulator pan 413 via the overflow drain 428.

The waste water in the accumulator pan 413 includes heat and chemicals from the wash water and the rinse water used during operation of the dishwashing machine 400 in addition to recycled waste water from the accumulator pan 413. The dishwashing machine 400 may also include product dispensers 431 and 432 for dispensing detergent, rinse aid, and/or sanitizer during the respective wash or rinse cycle of the dishwashing machine 400. The dishwashing machine 400 does not include a siphon drain.

In operation, the stopper 412 in the sump 406 keeps the rinse water in the sump 406 for use in the next wash cycle, and detergent is added to the rinse water for use in the wash cycle. The pump 407 pumps the wash water from the sump 406 into the wash arms 404*a*, and the wash water drains into the sump 406. After the wash cycle, the stopper 412 is lifted to unplug the drain 411 in the sump 406 to drain the wash water from the sump 406 into the accumulator pan 413. The wash water passes through the strainer 414 to filter out larger food particles from the wash water. The strainer 414 is preferably removable to aid in the disposal of the food particles. The wash water in the accumulator pan 413 is used during the pre-rinse cycle of the next cycle.

The pump 415 directs the wash water from the accumulator pan 413, through the wash arms 404*b*, and into the second cavity 401*b* where pre-rinse operation of the soiled dishes 403*b* occurs. The wash water drains by gravity through the drain 425 into the accumulator pan 413. The dishwashing machine 400 preferably has a control (not shown) to turn the pump 415 on or off to start or stop the flow of the pre-rinse water into the second cavity 401*b*. Any food particles from the pre-rinse operation are collected on the removable strainer 414. The flexible curtain member 436 allows an operator to slide the rack of dishes from the pre-rinse side of the second portion 401*b* over to the wash and rinse side of the first portion 401*a*.

As additional machine cycles are run, the water level in the accumulator pan 413 increases until it reaches the bottom of the overflow drain 428, where the water drains into the sewer S by gravity. A manual ball valve (not shown) or other suitable drain device well known in the art is preferably used to drain the water from the accumulator pan 413 at the end of the day or when the water becomes too soiled.

The arrows in solid lines show the general water flow path through the pre-rinse operation proximate the second portion 401*b* and through the wash and rinse operation proximate the first portion 401*a*. The arrows in broken lines show the general water flow path when the stopper 412 is lifted to allow water to flow through the fluid passageway 423 from the sump 406 into the accumulator pan 413. It is recognized that the pre-rinse operation and the wash or rinse operation could be run separately or substantially concurrently.

Optionally, the accumulator pan 413 could be fitted with a water level sensing device so that the pump 415 does not turn on unless a sufficient amount of water is in the accumulator pan 413 to prevent damage to the pump 415. The accumulator pan 413 could also be fitted with a heating device that would maintain the temperature of the waste water within the accumulator pan 413 at a desired temperature, which is especially useful during periods of non-use. The heating device could be controlled such that it does not turn on when the pump 415 is running to minimize the total electrical load required for the dishwashing machine 400.

FIG. 10 shows another preferred embodiment dishwashing machine 500, which includes a first machine 500*a* and a second machine 500*b*. Generally, machine 500*b* performs a pre-rinse operation utilizing waste water from machine 500*a*. Machine 500*a* performs a wash and rinse operation using a re-circulating wash, drain, refill, and re-circulating rinse sequence. Machines 500*a* and 500*b* could operate substantially concurrently or independently.

Machine 500*a* includes a housing 510*a* defining a cavity 501*a*, and door handles 540*a* are used to open a door (not shown) of the housing 510*a* to access the cavity 501*a*. A rack 502*a* configured and arranged to hold dishes 503*a* in an upright, generally vertical position is positioned within the cavity 501*a*. Wash arms 504*a* are preferably rotatably operatively connected proximate the top and the bottom of the housing 510*a* within the cavity 501*a*. It is recognized that the wash arms 504*a* could also be stationary. The wash arms 504*a* include nozzles through which wash water is dispensed onto the dishes 503*a* within the cavity 501*a* as the wash arms 504*a* rotate. The bottom of the housing 510*a* slants, shown slanting from the left side to the right side of the housing 510*a* in a downward direction, to allow waste water to flow by gravity into a sump 506 in fluid communication with the cavity 501*a*. It is recognized that the housing 510*a* could slant in any suitable manner. A pump 507 having a pump inlet 508 and a pump outlet 509 is in fluid communication with the sump 506. The pump inlet 508 interconnects the sump 506 and the pump 507, and the pump outlet 509 interconnects the pump 507 and the wash arms 504*a*. A strainer 505, which is preferably a screen member, within the sump 506 proximate the pump inlet 508 is configured and arranged to allow water through but to prevent larger food particles from going through the strainer 505 into the pump 507. The sump 506 includes a drain 511 proximate the bottom of the sump 506, and a stopper 512 is configured and arranged to plug the drain 511. The stopper 512 is preferably an electro-mechanical device well known in the art.

Machine 500*b* includes a housing 510*b* defining a cavity 501*b*, and door handles 540*b* are used to open a door (not shown) of the housing 510*b* to access the cavity 501*b*. A rack 502*b* configured and arranged to hold dishes 503*b* in an upright, generally vertical position is positioned within the cavity 501*b*. Wash arms 504*b* are preferably rotatably operatively connected proximate the top and the bottom of the housing 510*b* within the cavity 501*b*. It is recognized that the wash arms 504*b* could also be stationary. The wash arms 504*b* include nozzles through which wash water is dispensed onto the dishes 503*b* within the cavity 501*b* as the wash arms 504*b* rotate. The bottom of the housing 510*b* slants, shown slanting from the left side to the right side of the housing 510*b* in a downward direction, to allow waste water to flow by gravity into an accumulator pan 513 in fluid communication with the cavity 501*b*. It is recognized that the housing 510*b* could slant in any suitable manner. A pump 515 having a pump inlet 516 and a pump outlet 517 is in fluid communication with the accumulator pan 513. The pump inlet 516 interconnects the accumulator pan 513 and the pump 515, and the pump outlet 517 interconnects the pump 515 and the wash arms 504*b*.

When the stopper 512 of the first machine 500*a* is unplugged from the drain 511, the drain 511 is open and in fluid communication with the accumulator pan 513 via a fluid passageway 523. A strainer 514, which is preferably a removable screen member, proximate the opening into the accumulator pan 513 is configured and arranged to allow waste water through but to prevent larger food particles from going through the strainer 514 into the accumulator pan 513. An overflow drain 528 is in fluid communication with an overflow outlet 527 of the accumulator pan 513. The overflow drain 528 is positioned at a level within the accumulator pan 513 to prevent the accumulator pan 513 from overflowing, and the excess water in the accumulator pan 513 flows through the overflow drain 528 to the sewer S. As the dishwashing machine 500 runs through several cycles, waste water from both cavities 501*a* and 501*b* is added to the accumulator pan 513. The additional waste water "refreshes" the water in the accumulator pan 513 with relatively warmer water and water including additional chemicals. The additional waste water increases the water level within the accumulator pan 513, and the excess water is directed out of the accumulator pan 513 via the overflow drain 528.

The waste water in the accumulator pan 513 includes heat and chemicals from the wash water and the rinse water used during operation of the dishwashing machine 500 in addition to recycled waste water from the accumulator pan 513. The dishwashing machine 500 may also include product dispensers 531 and 532 for dispensing detergent, rinse aid, and/or sanitizer during the respective wash or rinse cycle of the dishwashing machine 500. The dishwashing machine 500 does not include a siphon drain.

In operation, the stopper 512 in the sump 506 keeps the rinse water in the sump 506 for use in the next wash cycle, and detergent is added to the rinse water for use in the wash cycle. The pump 507 pumps the wash water from the sump 506 into the wash arms 504*a*, and the wash water drains into the sump 506. After the wash cycle, the stopper 512 is lifted to unplug the drain 511 in the sump 506 to drain the wash water from the sump 506 into the accumulator pan 513. The wash water passes through the strainer 514 to filter out larger food particles from the wash water. The strainer 514 is preferably removable to aid in the disposal of the food particles. The wash water in the accumulator pan 513 is used during the pre-rinse cycle of the next cycle.

The pump 515 directs the wash water from the accumulator pan 513, through the wash arms 504*b*, and into the cavity 501*b* where pre-rinse operation of the soiled dishes 503*b* occurs. The wash water drains by gravity through the drain 525 into the accumulator pan 513. The dishwashing machine 500 preferably has a control (not shown) to turn the pump 515 on or off to start or stop the flow of the pre-rinse water into the cavity 501*b*. Any food particles from the pre-rinse operation are collected on the removable strainer 514. An operator moves the dishes from the pre-rinse side (machine 500*b*) over to the wash and rinse side (machine 500*a*) and then places dishes for pre-rinse operation in the cavity 501*b* of machine 500*b*.

As additional machine cycles are run, the water level in the accumulator pan 513 increases until it reaches the bottom of the overflow drain 528, where the water drains into the sewer S by gravity. A manual ball valve (not shown) or other suitable drain device well known in the art is preferably used to drain the water from the accumulator pan 513 at the end of the day or when the water becomes too soiled.

The arrows in solid lines show the general water flow path through the pre-rinse operation within machine 500*b* and through the wash and rinse operation within the machine 500*a*. The arrows in broken lines show the general water flow path when the stopper 512 is lifted to allow water to flow through the fluid passageway 523 from the sump 506 into the accumulator pan 513.

Optionally, the accumulator pan 513 could be fitted with a water level sensing device so that the pump 515 does not turn on unless a sufficient amount of water is in the accumulator pan 513 to prevent damage to the pump 515. The accumulator pan 513 could also be fitted with a heating device that would maintain the temperature of the waste water within the accumulator pan 513 at a desired temperature, which is especially useful during periods of non-use. The heating device could be controlled such that it does not turn on when the pump 515 is running to minimize the total electrical load required for the dishwashing machine 500.

With regard to the embodiments shown in FIGS. 8-10, because the pre-rinse operation is external to or separate from the wash and rinse operations, the rinse water could be used in the next wash cycle.

By using the waste water drained from the dishwashing machine for pre-rinsing the dishes, lower operating costs are realized by reusing heated water from the dishwashing machine instead of fresh, hot water. In addition, improved results are obtained by using chemicals in the waste water for pre-rinse operation.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A dishwashing system comprising:

(a) a first commercial dishwashing machine;

(b) an accumulator pan located under at least a portion of the first commercial dishwashing machine;

(c) a second commercial dishwashing machine laterally spaced apart from the first commercial dishwashing machine and from the accumulator pan; and (d) a conduit having a first end and a second end, the first end in fluid communication with the accumulator pan, and the second end in fluid communication with the second commercial dishwashing machine;

wherein water from the first commercial dishwashing machine flows into the accumulator pan through an air gap disposed between a bottom of the first commercial dishwashing machine and the accumulator pan.

2. The system of claim 1, wherein the accumulator pan further comprises a removable strainer.

3. The system of claim 2, wherein the removable strainer comprises a screen material.

4. The system of claim 1, wherein the second commercial dishwashing machine further comprises a strainer.

5. The system of claim 4, wherein the strainer on the second commercial dishwashing machine is a mesh.

6. The system of claim 1, wherein the accumulator pan further comprises an overflow aperture.

7. The system of claim 6, wherein the overflow aperture is vertically higher than an outlet of the accumulator pan.

8. The system of claim 1, further comprising drained wash water.

9. The system of claim 8, wherein the drained wash water comprises heat, detergent, rinse aid, sanitizer, or combinations thereof.

10. The system of claim 8, wherein the temperature of the drained wash water is between 110° F. and 150° F.

11. The system of claim 8, wherein the temperature of the drained wash water is between 100° F. and 120° F.

* * * * *